United States Patent [19]

Basdekas et al.

[11] 4,088,182

[45] May 9, 1978

[54] TEMPERATURE CONTROL SYSTEM FOR A J-MODULE HEAT EXCHANGER

[75] Inventors: Demetrios L. Basdekas, Rockville; George Macrae, Murrysville; Joseph M. Walsh, Pittsburgh, all of Pa.

[73] Assignee: The United States of America as represented by the United States Department of Energy, Washington, D.C.

[21] Appl. No.: 474,287

[22] Filed: May 29, 1974

[51] Int. Cl.[2] ..... F28F 27/00; G05D 23/00

[52] U.S. Cl. ..... 165/32; 60/644; 165/96; 122/32; 176/65; 290/2; 318/635

[58] Field of Search ..... 165/96, 32, 39; 176/65, 176/20; 122/32; 290/2; 60/644, 664, 665, 667, 649; 318/635; 236/78 D

[56] References Cited

U.S. PATENT DOCUMENTS

| | | | |
|---|---|---|---|
| 3,103,615 | 9/1963 | Vitale | 318/635 X |
| 3,498,880 | 3/1970 | Gollion | 165/96 X |
| 3,581,475 | 6/1971 | Sauder | 165/96 X |

FOREIGN PATENT DOCUMENTS

| | | | |
|---|---|---|---|
| 950,517 | 2/1964 | United Kingdom | 165/96 |

*Primary Examiner*—Albert W. Davis, Jr.
*Attorney, Agent, or Firm*—Frederick J. Baear, Jr.; Randall G. Erdley

[57] ABSTRACT

The level of primary fluid is controlled to change the effective heat transfer area of a heat exchanger utilized in a liquid metal nuclear power plant to eliminate the need for liquid metal control valves to regulate the flow of primary fluid and the temperature of the effluent secondary fluid.

4 Claims, 1 Drawing Figure

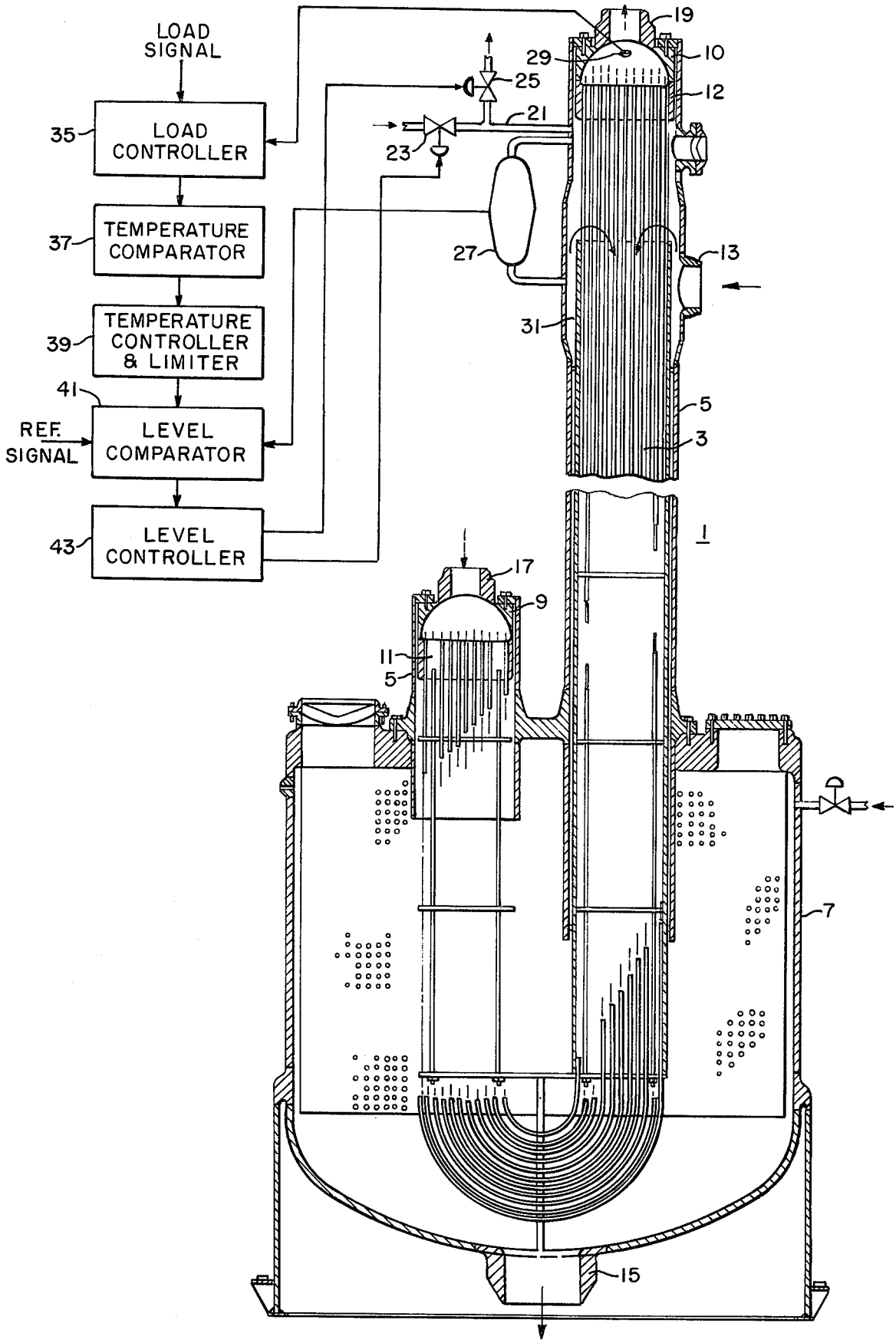
LOAD SIGNAL
LOAD CONTROLLER
TEMPERATURE COMPARATOR
TEMPERATURE CONTROLLER & LIMITER
REF. SIGNAL
LEVEL COMPARATOR
LEVEL CONTROLLER
35
37
39
41
43
19
29
10
25
12
21
23
27
13
31
5
3
1
17
9
11
5
7
15

TEMPERATURE CONTROL SYSTEM FOR A J-MODULE HEAT EXCHANGER

BACKGROUND OF THE INVENTION

1. Field of the Invention:

This invention relates to heat exchangers, and more particularly, to a temperature controller which varies the effective heat transfer surface of the heat exchanger.

2. Description of the Prior Art:

The demand for electrical power in the United States approximately doubles every ten years. Presently, fossil fuels provide a majority of the heat energy needed to produce electrical power. However, in the next thirty years, it is estimated that over fifty percent of our electrical energy will be produced utilizing heat resulting from nuclear reactions. Fusion nuclear reactions are not commercially available and the supply of fissionable material is limited, so that future nuclear power plants depend on developing economical fast breeder reactors which produce more fissionable material than they consume. To produce economical and reliable liquid metal fast breeder reactors, it is necessary to be able to control the temperature of the superheated steam or reheated steam within a range of approximately 5° to 10° F, if the turbines are to operate properly.

Large liquid metal control valves are considered beyond the present state of technology, and to develop the proper reliability in such valves would take an expensive research and development program. Temperature control could also be provided by controlling the output of the circulating or pumping devices; however, such controls would be expensive and increase the complexity of these devices and reduce their reliability.

SUMMARY OF THE INVENTION

In general, a temperature controller for a tube and shell heat exchanger in which primary fluid is utilized to heat a secondary fluid, when made in accordance with this invention, comprises a device for sensing the temperature of the effluent secondary fluid and producing a signal representative thereof, a device for supplying a pressurized gas to the shell of the heat exchanger, a device for controlling the flow of gas to and from the shell, and a device that is responsive to the signal of the temperature sensing device to change the level of the primary fluid in the shell and vary the effective heat transfer surface of the heat exchanger, whereby the temperature of the effluent secondary fluid is controlled.

BRIEF DESCRIPTION OF THE DRAWING

The objects and advantages of this invention will become more apparent from reading the following detailed description in connection with the accompanying drawing, in which:

The sole FIGURE is a sectional view of a heat exchanger incorporating a temperature controller made in accordance with this invention.

DESCRIPTION OF THE PREFERRED EMBODIMENT

Referring now to the drawing in detail, there is shown an evaporator, superheater or reheater heat exchanger 1 utilized to transfer heat from a primary fluid, a liquid metal, to a secondary fluid, water or steam, for a fast breeder nuclear power plant, which includes a turbogenerator.

The heat exchanger 1 has one or more J-shaped modular tube bundles 3 and shell portions 5, which surround or enwrap at least a portion of the stems of the J-shaped tube bundles 3. The modules are disposed in a common vessel 7 so that the shells are in fluid communication with the common vessel 7.

A head 9 or 10 having an integral tube sheet 11 or 12 is disposed on either end of the tube bundle 3 and is fastened to the shell portion 5 by welding or other means.

A primary fluid inlet nozzle 13 is disposed adjacent the upper end of the shell portion enwrapping the major stem portion of the tube bundle, and a primary fluid outlet nozzle 15 is centrally disposed in the lower portion of the common vessel 7.

A secondary fluid inlet nozzle 17 is centrally disposed in the head portion 9 disposed on the end of the minor stem portion of the tube bundle 3 and a secondary fluid outlet nozzle 19 is centrally disposed in the head portion 10 disposed on the end of the major stem portion of the tube bundle 3. Thus, the primary and secondary fluids generally flow in a countercurrent relationship in the major stem portion of the heat exchanger.

An inert gas conduit 21 is in fluid communication with the major stem portion of the shell 5 adjacent the tube sheet 12. An inert gas supply control valve 23 regulates the flow of pressurized inert gas to the shell 5, and an inert gas bleed control valve 25 regulates the amount of inert gas bled from the shell 5 so that in combination the valves 23 and 25 form means for controlling the flow of inert gas to and from the shell 5.

A level indicator 27 is either located within the shell 5 or is disposed adjacent the upper portion of the major stem portion of the tube bundle 3 and in fluid communication with the primary fluid in the shell. The level indicator 27 produces a signal, which is representative of the primary fluid liquid level in the major stem portion of the shell 5.

A thermocouple, thermistor, or other temperature measuring device, 29 is disposed adjacent the second fluid outlet nozzle 19 and is adapted to produce a signal representative of the temperature of the effluent secondary fluid.

For a more complete description of the heat exchanger, reference may be made to an application by W. G. Harris, Jr. and A. A. Massaro, filed Mar. 3, 1971 and assigned Application Ser. No. 120,423, which application is hereby incorporated by reference in this application.

Influent primary fluid enters the primary fluid inlet nozzle 13, flows over a sleeve 31 and over the outer surface of the tubes 3 into the common vessel 7 (not shown). The effluent primary fluid then returns to a pump or flows to another heat exchanger via the primary fluid outlet nozzle 15.

Influent secondary fluid enters the secondary fluid inlet nozzle 17, flows through the tubes 3 and into the major portion of the stem of the tube bundle 3. The secondary fluid generally flows countercurrent to the primary fluid. The heated or effluent secondary fluid then flows through the secondary fluid outlet nozzle 19 to another heat exchanger or to the turbine.

To control the temperature of the effluent secondary fluid, the level to which the primary fluid is allowed to rise in the shell enclosing the major portion of the stem of the J-shaped tube bundle 3 is controlled by regulating the flow of inert gas to and from the shell via the inert gas control valves 23 and 25. To control the valves 23 and 25, a signal representative of the load on the generator is sent to a load controller 35. The load controller 35 responds to the load signal to produce a calculated signal, which is representative of a proposed, programmed or reference effluent secondary fluid temperature for that load. The reference temperature signal is sent to a temperature comparator 37 along with a signal from the temperature sensing device 29, which produces a signal representative of the actual temperature of the effluent secondary fluid. These two temperature signals are compared in the temperature comparator 37, which produces an error signal representative of the disagreement of these two temperature signals. The temperature error signal is then sent to a temperature controller and limiter 39, which operates on the error signal from the temperature comparator 37 to produce a primary fluid level demand signal. The temperature controller and limiter 39 limits the value of this level demand signal in order to limit the permissible liquid level swings within the shell. The level demand signal is sent to a level comparator 41 along with a reference signal and a signal from the level sensing device 27, which produces a signal representative of the primary fluid level in the shell enclosing the major portion of the J-shaped tube bundle 3. The level comparator 41 compares these three input signals and produces an error signal representative of the disagreement of these three input signals. The level error signal from the level comparator 41 is then sent to a level controller 43, which sends signals to the control valves 23 and 25 to admit additional inert gas into the shell 5 via inert gas control valve 23 to lower the level of primary fluid, which in turn decreases the effective heat transfer area of the tube bundle and reduces the temperature of the effluent secondary fluid, or bleed inert gas, from the shell 5 via the inert gas control valve 25 to increase the level of primary fluid within the shell, which increases the effective heat transfer surface of the tube bundle, and thus increases the temperature of the effluent secondary fluid.

The control system hereinbefore described advantageously provides economical and reliable regulation of the temperature of the effluent secondary fluid without utilizing primary fluid flow control valves, which are beyond the present state of technology and would be expensive to develop, or without controlling the flow of primary fluid by varying the output of the primary fluid circulating device, which would further complicate this device and decrease its reliability.

What is claimed is:

1. A temperature controller for a tube and shell heat exchanger in which primary fluid flowing at a generally constant rate is utilized to heat secondary fluid, said temperature controller comprising means for sensing the temperature of the effluent secondary fluid and for producing a signal representative thereof, means for supplying a pressurized gas to the shell of the heat exchanger, means for controlling the flow of gas to and from the shell, means for sensing a load and producing a signal representative of a demanded secondary fluid temperature based on that load, means for comparing the signal from the temperature sensing means and the demanded temperature signal from the load sensing means, said comparing means producing a temperature error signal representative of the disagreement therebetween, means for producing an output signal representative of the demanded level from the temperature error signal and for limiting the demanded level output signal to some predetermined value, whereby said flow control means is responsive to said output signal to change the level of primary fluid in the shell and vary the effective heat transfer surface of the heat exchanger to control the temperature of the effluent secondary fluid.

2. A temperature controller as set forth in claim 1 and further comprising means for sensing the level of primary fluid in the shell and producing a signal representative of said level.

3. A temperature control system as set forth in claim 2 and further comprising means for comparing the limited level demand signal and the signal representative of the level of primary fluid and producing a level error signal representative of the disagreement therebetween to operate the means for controlling the flow of gas to and from the shell.

4. A temperature controller as set forth in claim 3 and further comprising means for producing a reference signal, means for comparing the reference signal with the limited level demand signal and the signal representative of the level of the primary fluid to produce a level error signal to operate the means for controlling the flow of gas to and from the shell in order to control the liquid level in the shell.

* * * * *